US012516436B2

(12) United States Patent
Inagaki et al.

(10) Patent No.: US 12,516,436 B2
(45) Date of Patent: Jan. 6, 2026

(54) FILM FORMING METHOD FOR METAL FILM

(71) Applicant: TOYOTA JIDOSHA KABUSHIKI KAISHA, Toyota (JP)

(72) Inventors: Koji Inagaki, Toyota (JP); Jyunya Murai, Nisshin (JP); Jun Yoshitomi, Toyota (JP); Yoji Sato, Kasugai (JP); Osamu Yamashita, Toyota (JP); Hiromichi Nakata, Toyota (JP); Masaaki Nishiyama, Komaki (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 18/432,533

(22) Filed: Feb. 5, 2024

(65) Prior Publication Data

US 2024/0263336 A1 Aug. 8, 2024

(30) Foreign Application Priority Data

Feb. 8, 2023 (JP) ..... 2023-017918

(51) Int. Cl.
*C25D 5/08* (2006.01)
*C25D 17/00* (2006.01)

(52) U.S. Cl.
CPC ..... *C25D 17/002* (2013.01); *C25D 17/004* (2013.01)

(58) Field of Classification Search
CPC ..... C25D 5/00; C25D 5/08
USPC ..... 205/148, 238, 261, 88
See application file for complete search history.

(56) References Cited

U.S. PATENT DOCUMENTS

2016/0265129 A1* 9/2016 Hiraoka ..... C25D 17/00
2020/0299855 A1* 9/2020 Sato ..... C25D 7/0642
2022/0403544 A1* 12/2022 Kondoh ..... C25D 3/00

FOREIGN PATENT DOCUMENTS

JP 2020-111807 A 7/2020
JP 2020-131286 A 8/2020
JP 2020132948 A * 8/2020 ..... C25D 17/00
JP 2021-010937 A 2/2021

* cited by examiner

*Primary Examiner* — Edna Wong
(74) *Attorney, Agent, or Firm* — Oliff PLC

(57) ABSTRACT

A film forming method for a metal film includes steps of, after a substrate material is mounted on a mounting table, forming the metal film on a surface of the substrate material with a plating solution brought into contact with the substrate material through an electrolyte membrane, and with the plating solution sealed, separating the electrolyte membrane from the substrate material by moving at least one of the mounting table and a container in a direction away from the other. The plating solution contained in the container is circulated through a circulation path outside the container, before or during the film forming step. A circulation path is blocked and the plating solution in the container is sealed, before this separating step.

7 Claims, 6 Drawing Sheets

FILM FORMING METHOD FOR METAL FILM

CROSS-REFERENCE TO RELATED APPLICATION

This application claims priority to Japanese Patent Application No. 2023-017918 filed on Feb. 8, 2023, incorporated herein by reference in its entirety.

BACKGROUND

1. Technical Field

The present disclosure relates to a film forming method for a metal film.

2. Description of Related Art

Conventionally, a metal film is formed by electroplating on a surface of a substrate material mounted on a mounting table. For example, in the film forming method disclosed in Japanese Unexamined Patent Application Publication No. 2020-132948 (JP 2020-132948 A), first, a plating solution contained in a container is brought into contact with the substrate material through an electrolyte membrane. Next, by applying a voltage between an anode and the substrate material, metal ions of the plating solution pass through the electrolyte membrane, thereby forming the metal film on the surface of the substrate material.

However, when the container is lifted in an attempt to separate the electrolyte membrane from the substrate material after forming the metal film, the electrolyte membrane may be deformed by the weight of the plating solution in the container. As a result, the electrolyte membrane is plastically deformed and this may lead to poor film forming of the metal film. Therefore, after the film forming, a negative pressure is generated in the plating solution in the container by sucking the plating solution in the container using a suction device with the electrolyte membrane and the substrate material in close contact with each other. While maintaining the state, the container is lifted and the electrolyte membrane attached to the mounting table is separated from the substrate material.

SUMMARY

However, the film forming method disclosed in JP 2020-111807 A requires the suction device for sucking the plating solution in the container, making a device configuration complex. The container cannot be lifted until the plating solution in the container becomes the negative pressure lower than an atmospheric pressure, and the timing for lifting the container must be determined by measuring a liquid pressure of the plating solution in the container. Therefore, the work becomes complex. In particular, when the plating solution contained in the container is circulated through a circulation path outside the container, the plating solution may be drawn in from the circulation path, making it difficult to bring the plating solution in the container to the negative pressure.

The present disclosure provides a film forming method for a metal film that can easily separate an electrolyte membrane from a substrate material while deformation of the electrolyte membrane is suppressed and a plating solution is contained in a container.

A film forming method for a metal film according to the present disclosure includes a mounting step of mounting a substrate material on a mounting table, a contacting step of bringing a plating solution contained in a container into contact with the substrate material through an electrolyte membrane attached to a lower portion of the container, a film forming step of applying a voltage between an anode disposed on an upper side of the electrolyte membrane and the substrate material such that metal ions of the plating solution pass through the electrolyte membrane and the metal film is formed on a surface of the substrate material, and a separating step of separating the electrolyte membrane from the substrate material by moving at least one of the mounting table and the container in a direction away from the other, after forming the metal film. The plating solution contained in the container is circulated through a circulation path outside the container, before or during the film forming step, and the circulation path is blocked and the plating solution in the container is sealed before the separating step.

According to the present disclosure, a voltage is applied between the anode and the substrate material with the plating solution brought into contact with the substrate material through the electrolyte membrane. As a result, the metal ions of the plating solution in the container pass through the electrolyte membrane, and the metal derived from the metal ions is deposited on the surface of the substrate material. The deposited metal can cause the metal film to be formed on the surface of the substrate material.

According to the present disclosure, the plating solution in the container is circulated through the circulation path outside the container before or during the film forming step, such that the metal film can be formed while composition of the plating solution is in a stable state. After forming the metal film, the mounting table and the container are moved in a direction away from each other and the electrolyte membrane is separated from the substrate material, such that the substrate material on which the metal film is formed can be removed from the mounting table.

Here, according to the present disclosure, the circulation path of the plating solution is blocked and the plating solution in the container is sealed before the separating step. Thus, when the substrate material is separated from the electrolyte membrane, the plating solution does not flow into the container through the circulation path, such that the electrolyte membrane can be suppressed from deforming downward (stretching downward so as to expand) due to the weight of the plating solution. As a result, with the plating solution contained in the container, the substrate material that has undergone the film forming and that is mounted on the mounting table is replaced with a new substrate material, and the metal film can be continuously formed on the new substrate material.

In the film forming method according to the aspect, the mounting table may be lowered with respect to the container in the separating step. According to this aspect, since the container is not lifted, vibration of equipment and the like does not easily act on the plating solution in the container, and also potential energy of the plating solution in the container does not increase. As a result, the deformation of the electrolyte membrane can be suppressed in the separating step.

In the film forming method according to the aspect, an anode that is insoluble with respect to the plating solution is used as the anode, and after the film forming step and before the plating solution is sealed, by circulating the plating solution through the circulation path, gas generated at the anode while forming the metal film may be discharged from the container to an outside.

According to this aspect, when an anode that is insoluble is used, the solvent (for example, water) contained in the plating solution is electrolyzed on the surface of the anode while forming the film, and gas (for example, oxygen gas) is generated. Since such gas is a compressible fluid unlike the plating solution, the volume of the gas is likely to change. Therefore, in this aspect, the generated gas is discharged to the outside of the container by circulating the plating solution. As a result, the container can be filled with the plating solution that is an incompressible fluid. Therefore, when the substrate material and the electrolyte membrane are separated from each other, the change in volume of the fluid in the container can be suppressed, and the deformation of the electrolyte membrane can be suppressed.

The film forming method according to the aspect may include a removing step of removing the substrate material on which the metal film is formed from the mounting table after the separating step, and steps from the mounting step to the removing step may be repeated.

According to this aspect, the state where the plating solution is sealed in the container can be maintained, such that steps from the mounting step to the removing step can be performed repeatedly without discharging the plating solution from the container. As a result, the time required for discharging the plating solution from the container and for resupplying the plating solution to the container can be omitted, and the film forming time can be shortened when a plurality of substrate materials is continuously formed.

According to the present disclosure, the electrolyte membrane can be easily separated from the substrate material with the plating solution contained in the container while suppressing the deformation of the electrolyte membrane.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Figure 1:
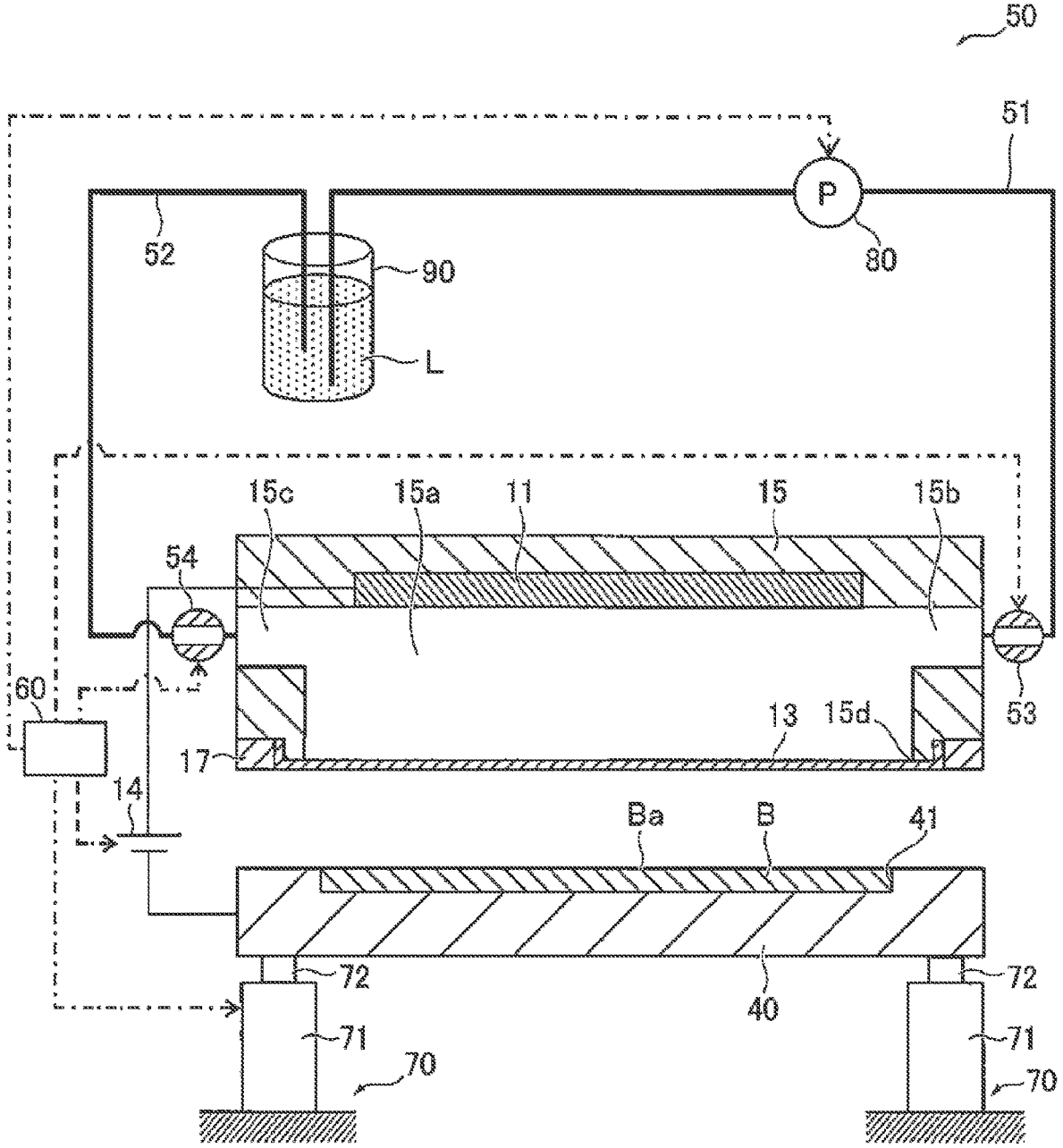
FIG. 1 is a schematic diagram of a film forming device used in a film forming method according to an embodiment of the present disclosure.

First, a film forming device 1 used in a film forming method for a metal film according to an embodiment of the present disclosure will be described. FIG. 1 is a schematic sectional view showing an example of the film forming device of the metal film according to the embodiment of the present disclosure.

1. Film Forming Device 1

As shown in FIG. 1, the film forming device 1 is a device for forming a metal film F on a substrate material B by electroplating with an electrolyte membrane 13 disposed between an anode 11 and the substrate material B. Specifically, the film forming device 1 includes the anode 11, the electrolyte membrane 13, and a power supply 14 that applies a voltage between the anode 11 and the substrate material B.

The film forming device 1 further includes a mounting table 40 on which the substrate material B is mounted, and a pair of linear actuators 70 for lifting and lowering the mounting table 40. Each of the linear actuators 70 has a rod 72 that linearly moves with respect to a main body 71, and the mounting table 40 is fixed to the distal ends of the rods 72. In the present embodiment, the electrolyte membrane 13 is disposed below the anode 11, and the mounting table 40 is disposed below the electrolyte membrane 13.

The substrate material B functions as a cathode. The substrate material B is a substrate material in a plate shape. In the present embodiment, the substrate material B is a substrate material in a rectangular shape. Of the surfaces of the substrate material B, the surface facing the electrolyte membrane 13 is a film-forming surface Ba that functions as a cathode. The material of the substrate material B is not particularly limited as long as it functions as a cathode (that is, a conductive surface). The substrate material B may be made of a metal material, such as aluminum and copper, for example. When a wiring pattern is formed from the metal film F, as for the substrate material B, a substrate material is used in which an underlying layer such as copper is formed on the surface of an insulating substrate material such as resin. In this case, after forming the metal film F, the underlying layer other than the portion where the metal film F is formed is removed by etching and the like. As a result, a wiring pattern of the metal film F can be formed on the surface of the insulating substrate material.

The anode 11 is, for example, a non-porous anode made of the same metal as the metal of the metal film. The anode 11 is in a block or a flat plate shape. The anode 11 is contained in a container 15 and disposed to be spaced apart from the electrolyte membrane 13. The anode 11 maybe porous, meshed, or a cage containing a plurality of balls. Examples of the material of the anode 11 include copper. The anode 11 is dissolved by the application of the voltage of the power supply 14.

However, when forming a film using only metal ions of a plating solution L, an anode that is insoluble with respect to the plating solution L is used as the anode 11. Examples of the material of the anode include titanium, stainless steel, and the like, and the surface of these materials may be coated with a noble metal and the like. Note that, in the following example, an anode that is insoluble will be described as an example of the anode 11. The anode 11 is electrically connected to a positive electrode of the power supply 14. A negative electrode of the power supply 14 is electrically connected to the substrate material B through the mounting table 40.

The plating solution L is a solution containing the metal of the metal film to be formed in the state of the ions. Examples of such metals include copper, nickel, gold, and silver. The plating solution L is a solution obtained by dissolving (ionizing) these metals with an acid such as nitric acid, phosphoric acid, succinic acid, sulfuric acid, sulfamic acid, or pyrophosphoric acid. Water is used as the solvent for the solution, but the solvent may be alcohol and the like as long as the metal can be contained in the state of the ions. For example, when the metal is copper, the plating solution L may be an aqueous solution containing copper sulfate, copper pyrophosphate, and the like.

The electrolyte membrane 13 is a membrane that can impregnate (contain) the metal ions internally together with the plating solution L by bringing the electrolyte membrane 13 into contact with the plating solution L. The electrolyte membrane 13 is a flexible membrane. The material of the electrolyte membrane 13 is not particularly limited as long as the metal ions of the plating solution L can move toward the substrate material B side when the voltage is applied by the power supply 14. Examples of materials for the electrolyte membrane 13 include resin including an ions exchange function, such as fluorine-based resin such as Nafion (registered trademark) manufactured by DuPont. The film thickness of the electrolyte membrane 13 is preferably in the range of 5 μm to 200 μm. More preferably, the film thickness is in the range of 20 μm to 60 μm.

The container 15 is made of a material that is insoluble with respect to the plating solution L. A container space 15*a* for containing the plating solution L is formed in the container 15. The anode 11 in a flat plate shape is disposed in the container space 15*a* of the container 15. An opening section 15*d* is formed on the substrate material B side (lower side) of the container space 15*a*. With a periphery of the electrolyte membrane 13 sandwiched between a frame 17 and the container 15, the electrolyte membrane 13 is attached to the lower portion of the container 15. As a result, the opening section 15*d* of the container 15 can be covered with the electrolyte membrane 13, and the plating solution L contained in the container space 15*a* of the container 15 can be sealed with the electrolyte membrane 13.

The linear actuators 70 vertically move the rods 72 with respect to the main bodies 71 and lift and lower the mounting table 40, such that the electrolyte membrane 13 and the substrate material B can be brought into contact with each other. In the present embodiment, the container 15 is fixed, and the mounting table 40 is lifted and lowered by the linear actuators 70. The linear actuator 70 is an electric actuator, and converts rotary motion of the motor into linear motion using a ball screw and the like (not shown). However, a hydraulic actuator or a pneumatic actuator may be used instead of the electric actuator.

The mounting table 40 is made of the metal material, and a container recessed portion 41 for containing the substrate material B is formed in the mounting table 40. The mounting table 40 and the substrate material B are electrically connected, and the negative electrode of the power supply 14 is connected to the mounting table 40. Note that the mounting table 40 may be provided with a suction mechanism (not shown) for sucking the electrolyte membrane 13 toward the mounting table 40 side while the electrolyte membrane 13 is in contact with the substrate material B.

The container 15 has a supply port 15*b* for supplying the plating solution L to the container space 15*a*. The container 15 has a discharge port 15*c* for discharging the plating solution L from the container space 15*a*. The supply port 15*b* and the discharge port 15*c* are holes communicating with the container space 15*a*. The supply port 15*b* and the discharge port 15*c* are formed with the container space 15*a* interposed therebetween. The supply port 15*b* is connected to a supply pipe 51. The discharge port 15*c* is connected to a discharge pipe 52.

The film forming device 1 further includes a tank 90, the supply pipe 51, the discharge pipe 52, and a pump 80. As shown in FIG. 1, the tank 90 contains the plating solution L. The supply pipe 51 connects the tank 90 and the container 15. The pump 80 is provided in the supply pipe 51. The pump 80 supplies the plating solution L from the tank 90 to the container 15. The discharge pipe 52 connects the tank 90 and the container 15.

Figure 3A:
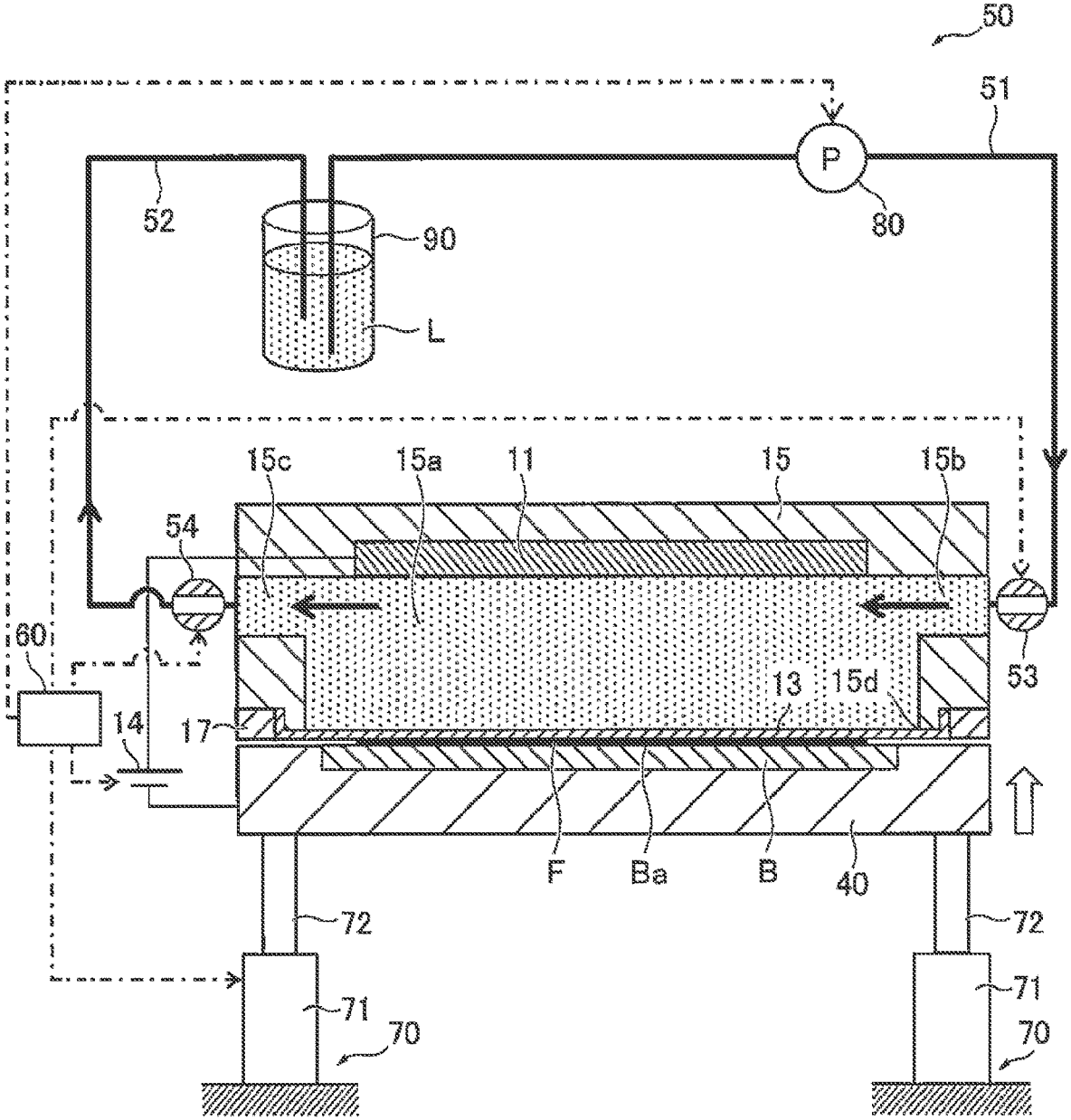
FIG. 3A is a diagram for explaining a film forming step using the film forming device shown in FIG. 1.
Figure 3B:
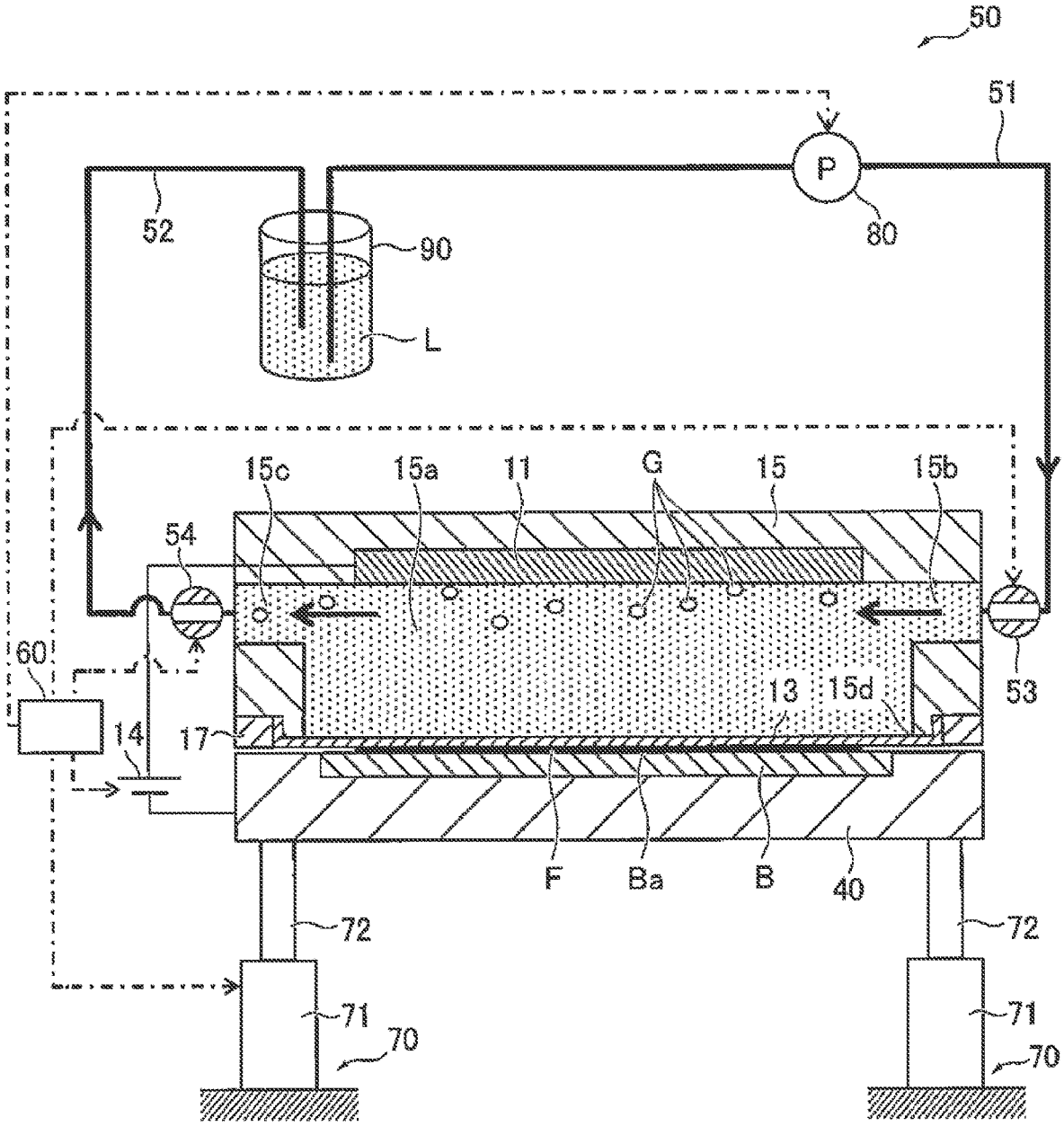
FIG. 3B is a diagram for explaining a circulating step using the film forming device shown in FIG. 1.
Figure 3C:
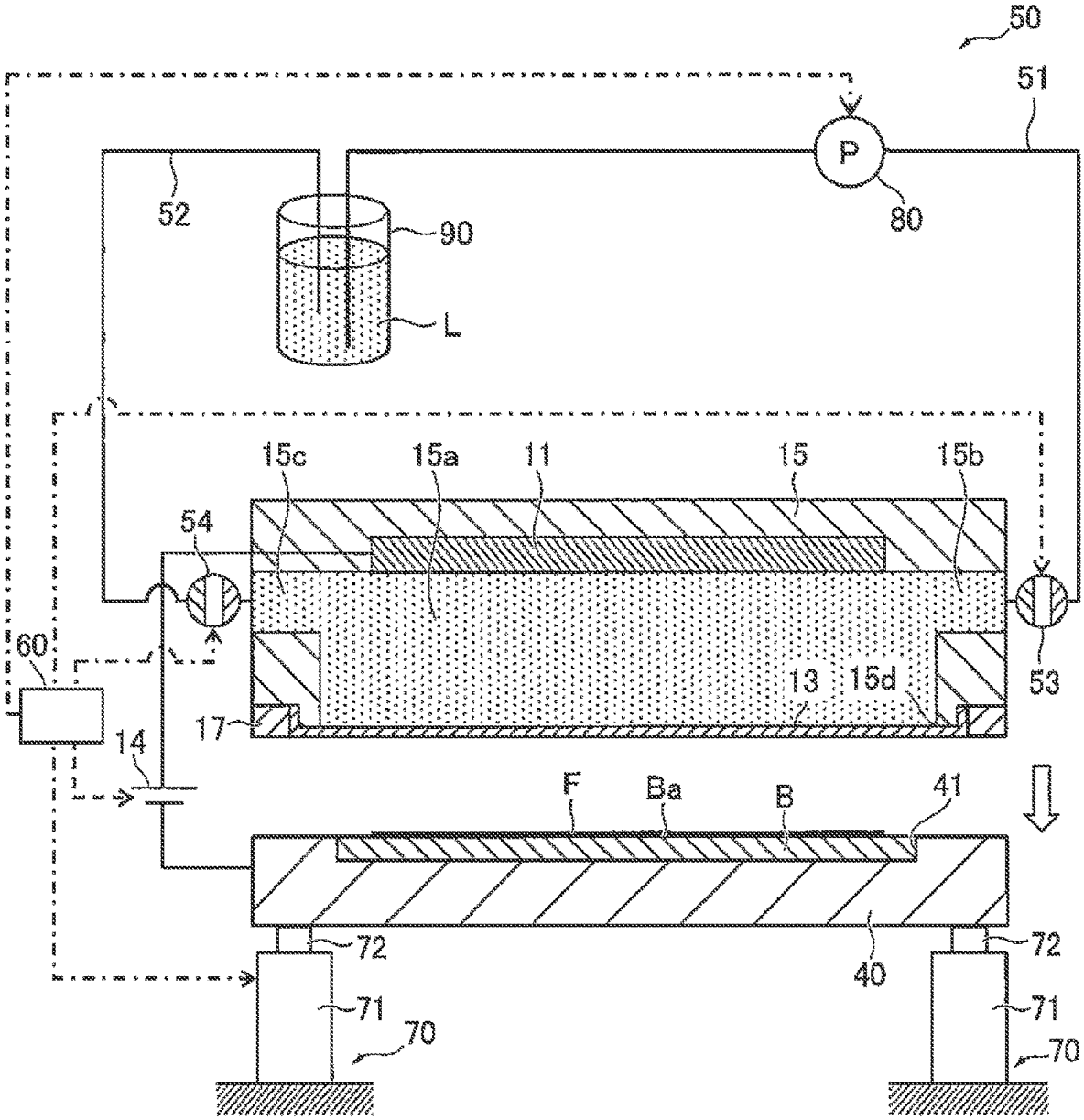
FIG. 3C is a diagram for explaining a separating step using the film forming device shown in FIG. 1.
Figure 3D:
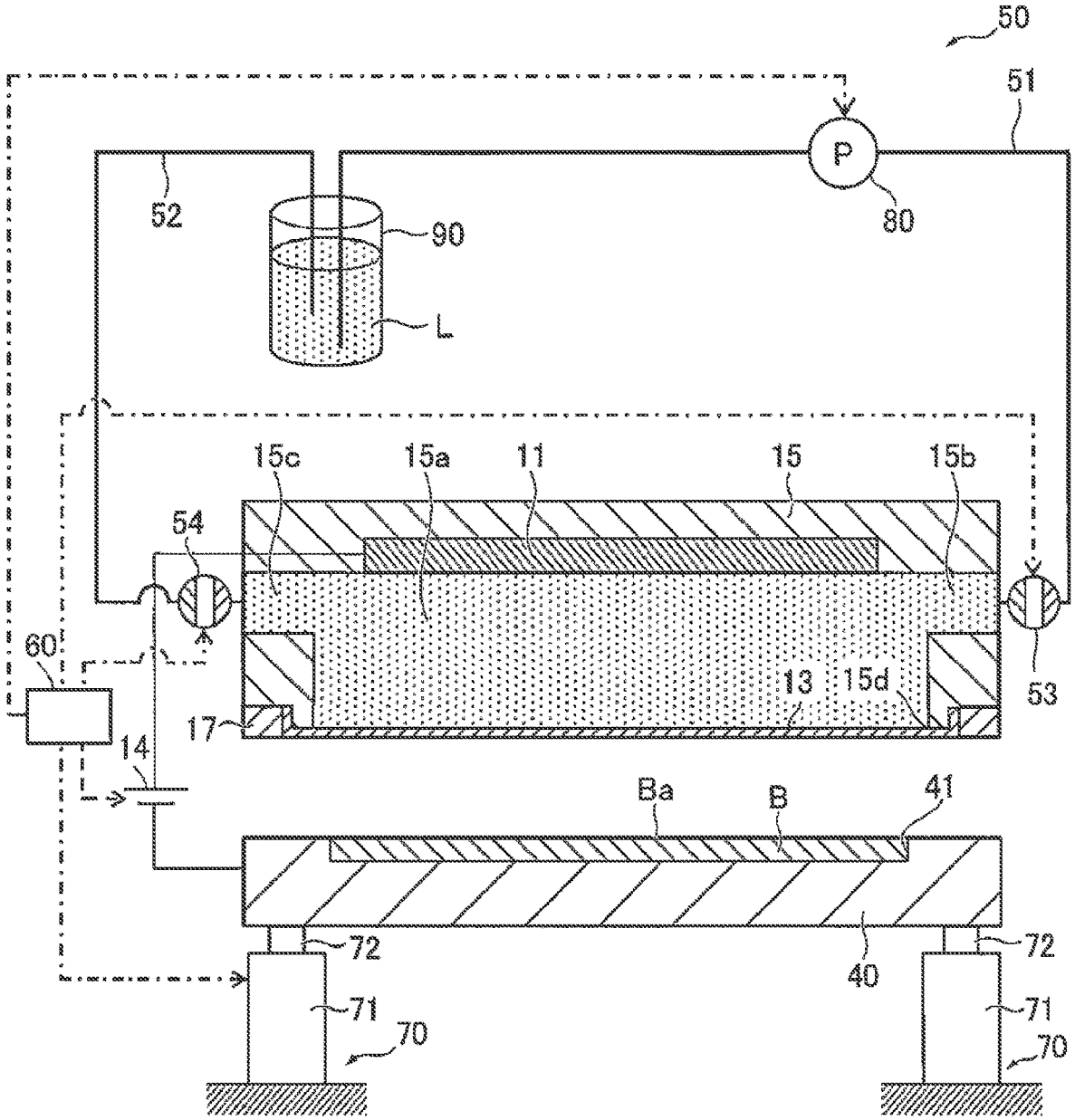
FIG. 3D is a diagram for explaining a mounting step in which a new substrate material is mounted using the film forming device shown in FIG. 1.

The supply pipe 51 is provided with an open/close valve (supply-side open/close valve) 53 for blocking the plating solution L supplied to the container 15. The discharge pipe 52 is provided with an open/close valve (discharge-side open/close valve) 54 for blocking the plating solution L discharged from the container 15. As for the open/close valves 53 and 54, a butterfly valve, a ball valve, a gate valve, a globe valve, and the like can be used. The categories of the open/close valves 53 and 54 are not particularly limited as long as they can be opened and closed manually or by a control signal from a control device 60. FIGS. 1, 3A, and 3B show that the open/close valves 53 and 54 are open. On the other hand, FIGS. 3C and 3D show that the open/close valves 53 and 54 are closed.

In the present embodiment, the plating solution L is sucked from the tank 90 into the supply pipe 51 by driving the pump 80 while the open/close valves 53 and 54 are open. The sucked plating solution L is pressure-fed from the supply port 15*b* to the container space 15*a*. The plating solution L in the container space 15*a* is returned to the tank 90 through the discharge port 15*c*. In this way, a circulation path 50 for circulating the plating solution L contained in the container 15 is formed outside the container 15.

On the other hand, when the open/close valves 53 and 54 are closed, the circulation path 50 is blocked. Inflow of the plating solution L into the container 15 is blocked, and outflow of the plating solution L from the container 15 is also blocked. Therefore, the inflow and the outflow of the plating solution L into/from the container 15 are blocked, such that the plating solution L in the container 15 is sealed.

Note that the open/close valve 53 may be provided at the supply port 15*b* of the container 15, and the open/close valve 54 may be provided at the discharge port 15*c* of the container 15. The discharge pipe 52 may be provided with a pressure regulating valve (not shown). The pressure regulating valve regulates the pressure (liquid pressure) of the plating solution L in the container space 15*a* to a predetermined pressure.

In the present embodiment, the film forming device 1 further includes the control device 60. The control device 60 includes a storage device (not shown) and an arithmetic device (not shown) that perform control to be described later. The storage device stores a program for executing the control flow shown in FIG. 2. The arithmetic device forms the metal film F by executing the program.

The control device 60 controls the driving of the linear actuators 70, the driving of the pump 80, the operation of the open/close valves 53 and 54, the application of the voltage by the power supply 14, and the like. The control device 60 performs these controls at the timing of the flow shown in FIG. 2 that will be described later. Note that the control device 60 may have an input device such as an operation switch, and these controls may be performed individually by manually operating the input device. The control by the control device 60 will be specifically described in the description of the film forming method that will be described later.

2. Film Forming Method

2-1. Mounting Step S1

The film forming method for the metal film according to the present embodiment will be described below.

Figure 2:
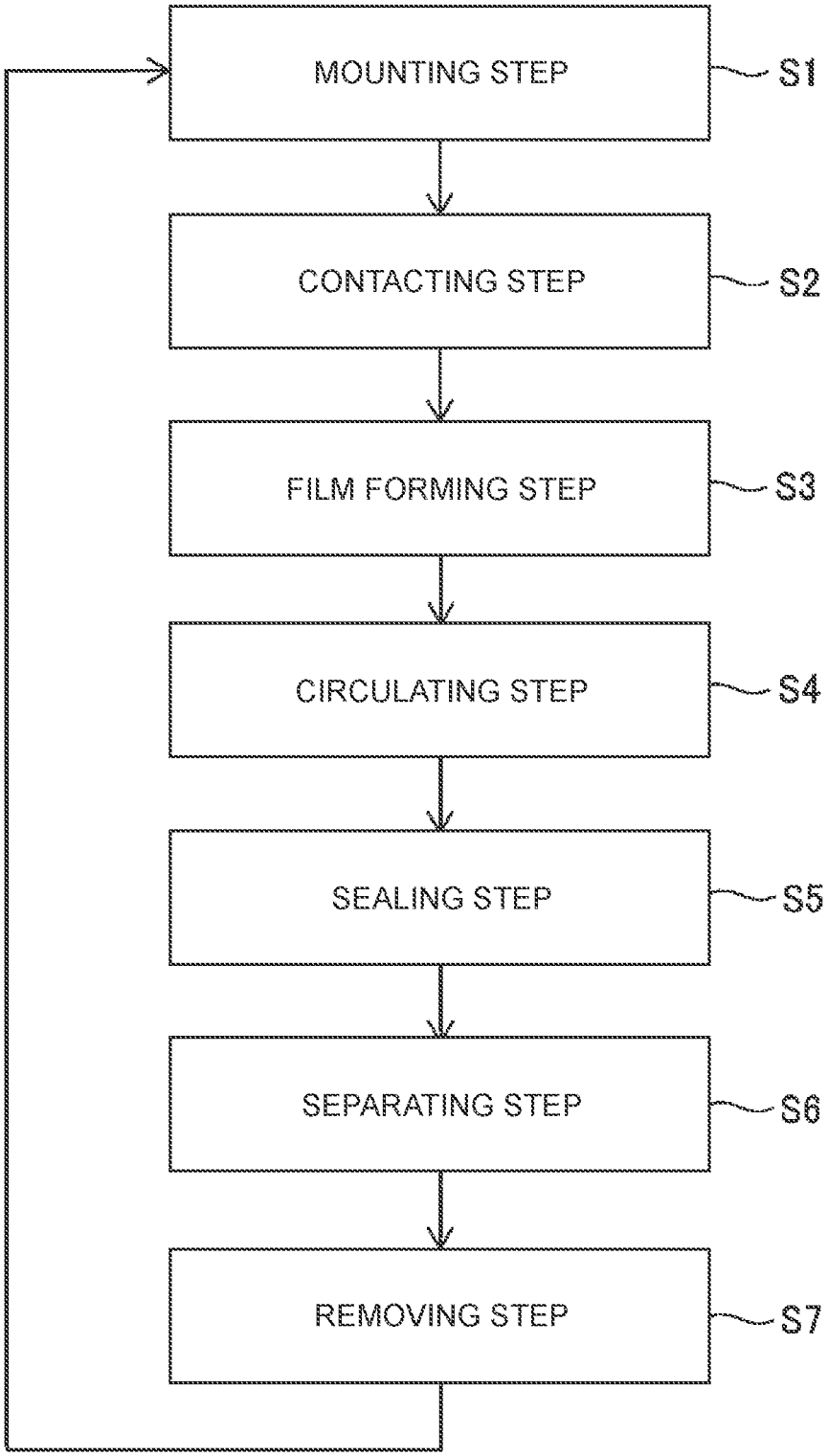
FIG. 2 is a flowchart of the film forming method using the film forming device shown in FIG. 1.

Mounting step S1 shown in FIG. 2 is performed. In this step, the substrate material B is mounted on the mounting table 40. Specifically, as shown in FIG. 1, the substrate material B is accommodated in the container recessed portion 41 of the mounting table 40. At this time, the film-forming surface Ba of the substrate material B faces the electrolyte membrane 13.

2-2. Contacting Step S2

Next, contacting step S2 shown in FIG. 2 is performed. In this step, the plating solution L contained in the container 15 is brought into contact with the substrate material B through the electrolyte membrane 13. Specifically, the control device 60 drives the linear actuators 70 to lift the mounting table 40 toward the container 15. As a result, the electrolyte membrane 13 attached to the container 15 is brought into contact with the substrate material B.

Next, the control device 60 opens the open/close valves 53 and 54. The open/close valves 53 and 54 may be opened before the mounting table 40 is lifted. However, when the open/close valves 53 and 54 are in the open state, that state is maintained.

Next, the control device 60 drives the pump 80. Thus, the plating solution L stored in the tank 90 is sucked by the pump 80, the plating solution L is pressure-fed into the container space 15*a* of the container 15 through the open/close valve 53, and the container space 15*a* is filled with the plating solution L. As a result, the plating solution L contained in the container 15 can be brought into contact with the substrate material B through the electrolyte membrane 13.

Further, the supplied plating solution L passes through the container space 15*a* of the container 15 and is returned to the tank 90 through the open/close valve 54. In this way, the plating solution L can be circulated through the circulation path 50. Note that the circulation of the plating solution L may be terminated by stopping the pump 80 after replacing the plating solution L in the container 15 by the amount required for one film forming.

Note that, the liquid pressure of the plating solution L in the container 15 maybe regulated by a discharge pressure of the pump 80. Alternatively, the pressure regulating valve may be further provided downstream of the container 15 to set the liquid pressure of the plating solution L in the container space 15*a* by the pressure regulating valve.

2-3. Film Forming Step S3

Next, film forming step S3 shown in FIG. 2 is performed (see FIG. 3A). In this step, a voltage is applied between the anode 11 and the substrate material B while the plating solution L in the container 15 is circulated in the circulation path 50. As a result, the metal ions of the plating solution L is allowed to pass through the electrolyte membrane 13 to form the metal film F on the surface of the substrate material B.

Specifically, a voltage is applied between the anode 11 in contact with the plating solution L and the substrate material B by controlling the power supply 14 with the control device 60. As a result, the metal ions of the plating solution L in the container 15 is allowed to pass through the electrolyte membrane 13, and the metal derived from the metal ions can be deposited on the surface of the substrate material B. By applying a voltage for a predetermined time, the metal film F with a predetermined film thickness can be formed on the surface of the substrate material B. In this way, by driving the pump 80 in the circulation path 50 between the tank 90 in which the plating solution L is stored and the container 15, the metal film F with a predetermined film thickness can be formed while the plating solution L is circulated.

2-4. Circulating Step S4

Next, circulating step S4 shown in FIG. 2 is performed (see FIG. 3B). By circulating the plating solution L in the container 15 through the circulation path 50 outside the container 15, gas G generated at the anode 11 during the film forming is discharged from the container 15 to the outside.

Circulating step S4 is performed for the following reasons. In the present embodiment, since an anode 11 that is insoluble with respect to the plating solution L is used, the solvent of the plating solution L is electrolyzed and the gas G derived from the solvent is generated from the surface of the anode 11 during the film forming. For example, when the solvent of the plating solution L is water, oxygen gas is generated. Since the gas G is a compressible fluid, even when sealing step S5 described below is performed, due to the weight of the plating solution L in the container 15, the gas G retained in the container 15 expands and the electrolyte membrane 13 deforms in separating step S6.

For this reason, circulating step S4 is performed in the present embodiment. Note that, when a soluble anode is used, circulating step S4 does not have to be performed because gas is less likely to be generated in the anode during the film forming. In the present embodiment, after the application of the voltage between the anode 11 and the substrate material B is canceled (after the film forming is completed), the pump 80 is continuously driven for a predetermined time, and then the driving of the pump 80 is stopped. As a result, after film forming step S3 and before sealing step S5, the plating solution L in the container 15 is circulated through the circulation path 50, and the gas G generated at the anode 11 during the film forming is discharged to the outside from the container 15.

2-5. Sealing Step S5

Next, sealing step S5 shown in FIG. 2 is performed. In this step, after the metal film F is formed, the circulation path 50 is blocked and the plating solution L in the container 15 is sealed. Specifically, in the present embodiment, first, the driving of the pump 80 is stopped by the control device 60. As a result, the pressure of the plating solution L in the container 15 is released to the atmospheric pressure. After that, the control device 60 closes the open/close valves 53 and 54. As a result, the inflow of the plating solution L into the container space 15*a* and the outflow of the plating solution L from the container space 15*a* can be blocked while the container space 15*a* of the container 15 is filled with the plating solution L.

2-6. Separating Step S6

Next, separating step S6 shown in FIG. 2 is performed (see FIG. 3C). In this step, with the plating solution L sealed in the container 15, at least one of the mounting table 40 and the container 15 is moved in a direction away from the other to separate the electrolyte membrane 13 from the substrate material B. In the present embodiment, the control device 60 drives the linear actuators 70 to lower the mounting table 40 with respect to the container 15. As a result, the substrate material B can be separated from the electrolyte membrane 13 without increasing potential energy of the plating solution L contained in the container 15. In the present embodiment, the container 15 is fixed and the mounting table 40 is lifted and lowered, but the mounting table 40 may be fixed and the container 15 may be lifted and lowered, for example.

2-7. Removing Step S7

Next, removing step S7 shown in FIG. 2 is performed (see FIG. 3D). In this step, the control device 60 controls a replacement device (not shown) and removes the substrate material B on which the metal film F is formed from the mounting table 40. After that, the step is returned to mounting step S1, a replacement device (not shown) is controlled, and a new substrate material B is disposed on the mounting table 40.

In this way, according to the present embodiment, in sealing step S5, the circulation path 50 of the plating solution L is blocked and the plating solution L in the container 15 is sealed. Thus, when the substrate material B is separated from the electrolyte membrane 13, the plating solution L does not flow into the container 15 through the circulation path 50, suppressing the electrolyte membrane 13 from being deformed downward due to the weight of the plating solution L. As a result, as shown in FIG. 3D, with the plating solution L contained in the container 15, the substrate material B that has undergone the film forming and that is mounted on the mounting table 40 is replaced with the new substrate material B, and the metal film F can be continuously formed on the new substrate material B.

Furthermore, in circulating step S4, since the gas G in the container 15 is discharged, the container 15 can be filled with the plating solution L that is an incompressible fluid. Therefore, when the substrate material B and the electrolyte membrane 13 are separated from each other, the change in volume of the fluid in the container 15 can be suppressed, and the deformation of the electrolyte membrane 13 can be suppressed.

Although the embodiment of the present disclosure has been described in detail above, the present disclosure is not limited to the embodiment, and various design changes can be made without departing from the spirit of the present disclosure described in the claims.

What is claimed is:

1. A film forming method for a metal film, the film forming method comprising:

a mounting step of mounting a substrate material on a mounting table;

a contacting step of bringing a plating solution contained in a container into contact with the substrate material through an electrolyte membrane attached to a lower portion of the container;

a film forming step of applying a voltage between an anode disposed on an upper side of the electrolyte membrane and the substrate material such that metal ions of the plating solution pass through the electrolyte membrane and the metal film is formed on a surface of the substrate material;

a circulating step in which the plating solution contained in the container is circulated through a circulation path outside the container, during the film forming step, the circulation path including (i) a pump sucking the plating solution from a tank and (ii) a valve downstream of the pump, wherein the plating solution is pressure-fed into the container through the valve;

after the metal film is formed, a sealing step of stopping the pump and subsequently closing the valve to block the circulation path and sealing the plating solution, the sealing step being performed while the plating solution contained in the container is in contact with the substrate material through the electrolyte membrane; and after the sealing step, a separating step of separating the electrolyte membrane from the substrate material by moving at least one of the mounting table and the container in a direction away from the other, after forming the metal film, wherein the separating step is performed with the plating solution sealed in the container.

2. The film forming method according to claim 1, wherein the mounting table is lowered with respect to the container in the separating step.

3. The film forming method according to claim 1, wherein:

an anode that is insoluble with respect to the plating solution is used as the anode; and after the film forming step and before the sealing step, by circulating the plating solution through the circulation path, gas generated at the anode while forming the metal film is discharged from the container to an outside.

4. The film forming method according to claim 1, further comprising a removing step of removing the substrate material on which the metal film is formed from the mounting table after the separating step, wherein steps from the mounting step to the removing step are repeated.

5. The film forming method according to claim 1, wherein, in the sealing step, stopping the pump releases a pressure of the plating solution in the container to an atmospheric pressure.

6. The film forming method according to claim 1, wherein a liquid pressure of the plating solution in the container is regulated by a discharge pressure of the pump.

7. The film forming method according to claim 1, wherein a liquid pressure of the plating solution in the container is regulated by a pressure regulating valve provided downstream of the container which sets the liquid pressure inside the container to a predetermined pressure.

* * * * *